US007830090B2

(12) United States Patent
Seon et al.

(10) Patent No.: US 7,830,090 B2
(45) Date of Patent: Nov. 9, 2010

(54) LIGHT EMISSION DEVICE AND DISPLAY DEVICE USING THE LIGHT EMISSION DEVICE AS A LIGHT SOURCE

(75) Inventors: Hyeong-Rae Seon, Yongin-si (KR); Dong-Su Chang, Yongin-si (KR); Jae-Young Lee, Yongin-si (KR)

(73) Assignee: Samsung SDI Co., Ltd., Yongin-si (KR)

( * ) Notice: Subject to any disclaimer, the term of this patent is extended or adjusted under 35 U.S.C. 154(b) by 413 days.

(21) Appl. No.: 12/035,949

(22) Filed: Feb. 22, 2008

(65) Prior Publication Data

US 2008/0265770 A1 Oct. 30, 2008

(30) Foreign Application Priority Data

Apr. 24, 2007 (KR) ..... 10-2007-0039860

(51) Int. Cl.
*H01J 1/62* (2006.01)
*H01J 63/04* (2006.01)
*H01J 17/24* (2006.01)

(52) U.S. Cl. ..... 313/560; 313/495; 313/553; 313/481; 313/554

(58) Field of Classification Search ..... 313/495, 313/553, 481, 546, 549, 554, 555, 560, 562; 417/48, 51
See application file for complete search history.

(56) References Cited

U.S. PATENT DOCUMENTS

| | | | | |
|---|---|---|---|---|
| 5,734,226 | A | 3/1998 | Cathey | |
| 6,486,600 | B1 | 11/2002 | Azuma et al. | |
| 7,348,721 | B2 * | 3/2008 | Hirasawa et al. | 313/495 |
| 2003/0090196 | A1 | 5/2003 | Ando | |

FOREIGN PATENT DOCUMENTS

| | | | |
|---|---|---|---|
| CN | 1508836 | | 6/2004 |
| KR | 10-0019349 | A | 3/2001 |
| KR | 2001-0056152 | A | 7/2001 |
| KR | 10-2006-0124339 | A | 12/2006 |

* cited by examiner

*Primary Examiner*—Nimeshkumar D Patel
*Assistant Examiner*—Anthony T Perry
(74) *Attorney, Agent, or Firm*—Christie, Parker & Hale, LLP

(57) ABSTRACT

A light emission device having an evaporating getter unit and a display device utilizing the light emission device as a light source. The light emission device includes a vacuum vessel having first and second substrates facing each other and a sealing member, the first and second substrates having an active area and a non-active area, an electron emission unit located on the first substrate at the active area, a light emission unit located on the second substrate at the active area, a getter unit provided between the first and second substrates at the non-active area, and a barrier disposed between the getter unit and the active area. The barrier blocks diffusion of getter material toward the active area during the getter activating process and prevents (or reduces) a slip or a movement of the getter unit.

17 Claims, 9 Drawing Sheets

LIGHT EMISSION DEVICE AND DISPLAY DEVICE USING THE LIGHT EMISSION DEVICE AS A LIGHT SOURCE

CROSS-REFERENCE TO RELATED APPLICATION

This application claims priority to and the benefit of Korean Patent Application No. 10-2007-0039860, filed on Apr. 24, 2007, in the Korean Intellectual Property Office, the entire content of which is incorporated herein by reference.

BACKGROUND OF THE INVENTION

1. Field of the Invention

The present invention relates to a light emission device having a vacuum vessel and a display device using the light emission device as a light source.

2. Description of Related Art

There are many different types of light emission devices that can radiate visible light. One type of light emission device includes a structure in which electron emission regions and driving electrodes are disposed on a first substrate, and a phosphor layer and an anode electrode are disposed on a second substrate. The first and second substrates are sealed to each other at their peripheries using a sealing member, and the inner space between the first and second substrates is exhausted to form a vacuum vessel (or a vacuum chamber).

In operation, the electron emission regions emit electrons toward the phosphor layer, and the electrons excite the phosphor layer to cause it to emit visible light. An emission amount of the electrons is controlled by driving voltages applied to the driving electrodes. The anode electrode receives a high voltage of a few thousand volts to accelerate the electrons toward the phosphor layer.

When the vacuum vessel is in a high vacuum state, emission efficiency and durability of the electron emission regions can be improved. Therefore, a getter unit is provided inside the vacuum vessel. After an exhaust process of the vacuum vessel, a getter activating process is conducted to cause the inner space of the vacuum vessel to be in the high vacuum state. The getter activating process includes activating a getter material and chemically adsorbing gaseous molecules remaining within the vacuum vessel.

In a conventional light emission device, the getter unit may be located between the first and second substrates at a non-active area at which the driving electrodes and the phosphor layer are not formed. Alternatively, the getter unit may be located inside a getter chamber that is attached to the first substrate at the non-active area. The inner space of the getter chamber is connected to the inner space of the vacuum vessel.

However, in a case where an evaporating getter unit is located between the first and second substrates at the non-active area, a conductive getter material may be diffused into an active area on which the driving electrodes and the phosphor layer are formed. Accordingly, this may cause a short circuit between adjacent driving electrodes and damage to the phosphor layer.

In addition, in a case where the getter unit is located inside of the getter chamber, manufacture of the vacuum vessel is complicated by adding a hole-forming process on the first substrate where the getter chamber is to be attached and the getter chamber sealing process on an exterior of the first substrate.

The above information disclosed in this Background section is only for enhancement of understanding of the background of the invention and therefore it may contain information that does not form the prior art that is already known in this country to a person of ordinary skill in the art.

SUMMARY OF THE INVENTION

An aspect of an embodiment of the present invention is directed toward a getter unit of a light emission device having a vacuum vessel that is for adsorbing gaseous molecules remaining within the vacuum vessel after exhaust process. Aspects of embodiments of the present invention are directed toward a light emission device that does not need an installation of a getter chamber and that can prevent (or protect from) a short circuit between adjacent driving electrodes and damage of a phosphor layer during a getter activating process, and a display device using the light emission device as a light source.

In an exemplary embodiment of the present invention, a light emission device includes (i) a vacuum vessel including a first substrate and a second substrate facing the first substrate with a gap therebetween, the first and second substrates having an active area and a non-active area surrounding the active area, and a sealing member disposed between the first and second substrates and surrounding the non-active area; (ii) an electron emission unit located on the first substrate at the active area; (iii) a light emission unit located on the second substrate at the active area; (iv) a getter unit provided between the first and second substrates at the non-active area; and (v) a barrier disposed between the getter unit and the active area. The barrier includes a first barrier having a length and a height. The height is substantially identical with that of the gap between the first and second substrates, and a pair of second barriers extended from side end portions (e.g., both-side ends or both-side end portions) of the first barrier toward the sealing member and having a height that is smaller than the height of the first barrier.

In one embodiment, the getter unit includes: a getter receptacle for containing an evaporating getter material; and a pair of supports for supporting the getter receptacle in the vacuum vessel. The supports are adapted to be modifiable in a first direction parallel to a direction extending from the electrode emission unit to the light emission unit of the light emission device and a second direction perpendicular to the first direction by an external force applied to the light emission device, and a position of the supports is adapted to be fixed in place by the second barriers. The getter receptacle may be mounted on one of the first substrate or the second substrate, and the supports may include: a pair of inclined portions extended from the getter receptacle toward the other one of the first substrate or the second substrate and having an interval therebetween that gradually increases as a distance away from the getter receptacles increases; and a pair of fixed portions extended from the inclined portions so as to be parallel with a side of the first substrate facing the second substrate and with a side of the second substrate facing the first substrate. The second barriers may be provided to contact the other one of the first substrate or the second substrate, and the fixed portions may be located between the pair of second barriers while contacting the second barriers. The getter receptacle may include a plurality of getter receptacles each being supported by a corresponding pair of the supports, one of the fixed portions may be disposed between two adjacent getter receptacles of the plurality of getter receptacles, and the outermost portions of the fixed portions may contact the second barriers.

In one embodiment, the electron emission unit includes: a plurality of cathode electrodes; a plurality of gate electrodes crossing the cathode electrodes and insulated from the cathode electrodes; and a plurality of electron emission regions electrically connected to the cathode electrodes. The electron emission unit may further include a focusing electrode disposed between the light emission unit and the cathode and gate electrodes.

In one embodiment, the electron emission unit includes: a plurality of first electrodes; a plurality of second electrodes crossing the first electrodes and insulated from the first electrodes; a plurality of first conductive layers electrically connected to the first electrodes; a plurality of second conductive layers electrically connected to the second electrodes and spaced apart from the first conductive layers; and a plurality of electron emission regions between the first and second conductive layers.

In one embodiment, the light emission unit includes: an anode electrode; and a phosphor layer on a side of the anode electrode, the phosphor layer being for emitting white visible light.

In one embodiment, the light emission unit includes: an anode electrode; red, green, and blue phosphor layers on a side of the anode electrode and spaced apart from each other; and a black layer between the phosphor layers.

In another exemplary embodiment of the present invention, a display device includes a display panel for displaying an image and a light emission device for emitting light toward the display panel. The light emission device includes (i) a vacuum vessel including a first substrate and a second substrate facing the first substrate with a gap therebetween, the first and second substrates having an active area and a non-active area surrounding the active area, and a sealing member disposed between the first and second substrates and surrounding the non-active area; (ii) an electron emission unit located on the first substrate at the active area; (iii) a light emission unit located on the second substrate at the active area; (iv) a getter unit provided between the first and second substrates at the non-active area; and (v) a barrier disposed between the getter unit and the active area. The barrier includes a first barrier having a length and a height. The height is substantially identical with that of the gap between the first and second substrates, and a pair of second barriers extended from side end portions (e.g., both-side ends or both-side end portions) of the first barrier toward the sealing member and having a height that is smaller than the height of the first barrier.

In one embodiment, the display panel includes a plurality of first pixels, and the light emission device includes a plurality of second pixels, the second pixels being less in number than the first pixels and a luminance of each of the second pixels being independently controlled. The display panel may be a liquid crystal display panel.

DETAILED DESCRIPTION

Figure 1:
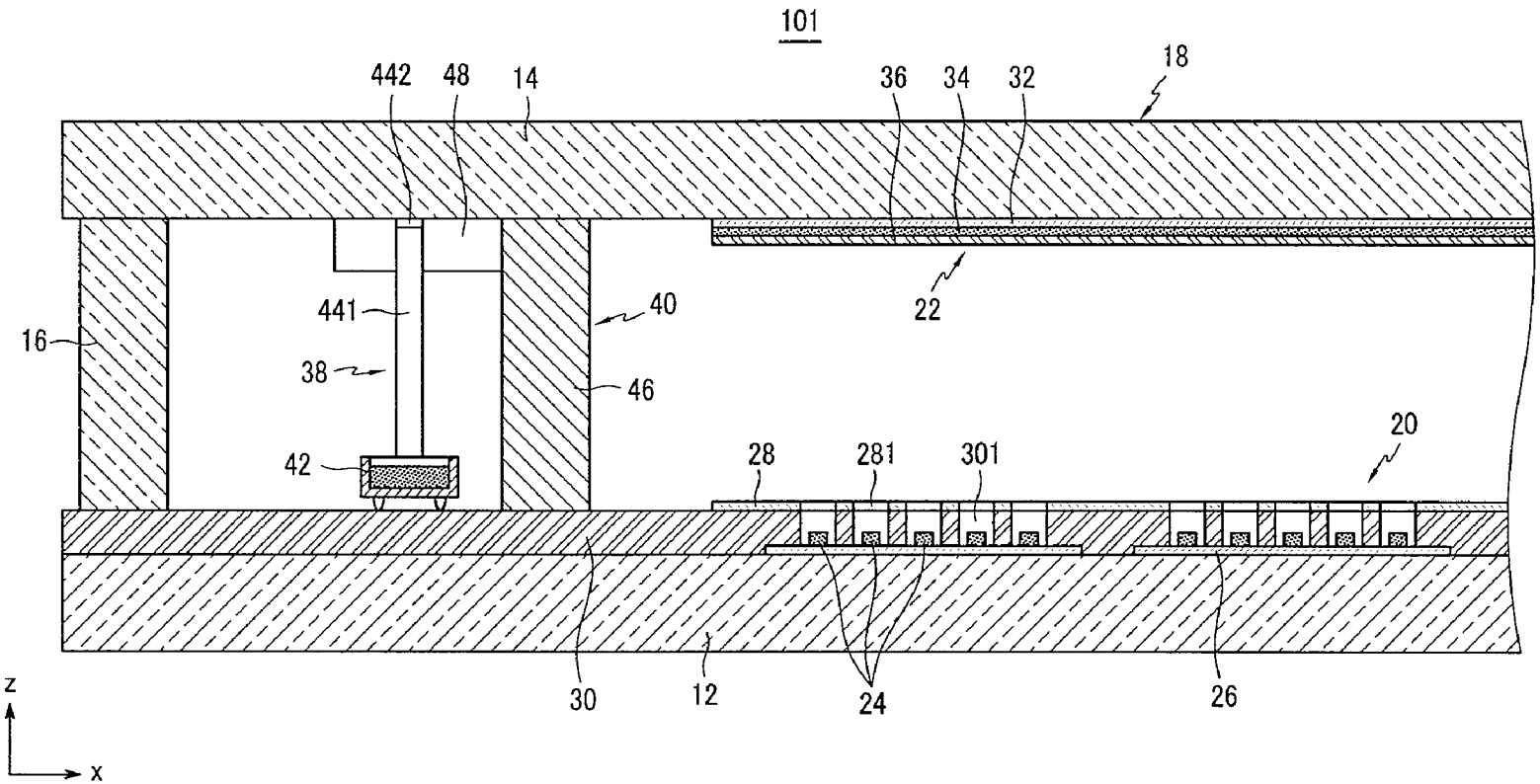
FIG. 1 is a partial sectional view illustrating a light emission device according to a first exemplary embodiment of the present invention.

In the following detailed description, only certain exemplary embodiments of the present invention are shown and described, by way of illustration. As those skilled in the art would recognize, the invention may be embodied in many different forms and should not be construed as being limited to the embodiments set forth herein. Also, in the context of the present application, when an element is referred to as being "on" another element, it can be directly on the another element or be indirectly on the another element with one or more intervening elements interposed therebetween. Like reference numerals designate like elements throughout the specification.

In exemplary embodiments of the present invention, all suitable light emission devices that can emit light to an external side are regarded as light emission devices. Therefore, all suitable display devices that can transmit information by displaying symbols, letters, numbers, and images may be regarded as the light emission devices. In addition, a light emission device may be used as a light source for emitting light to a display panel that is of a passive type (or a non-emissive type).

Figure 2:
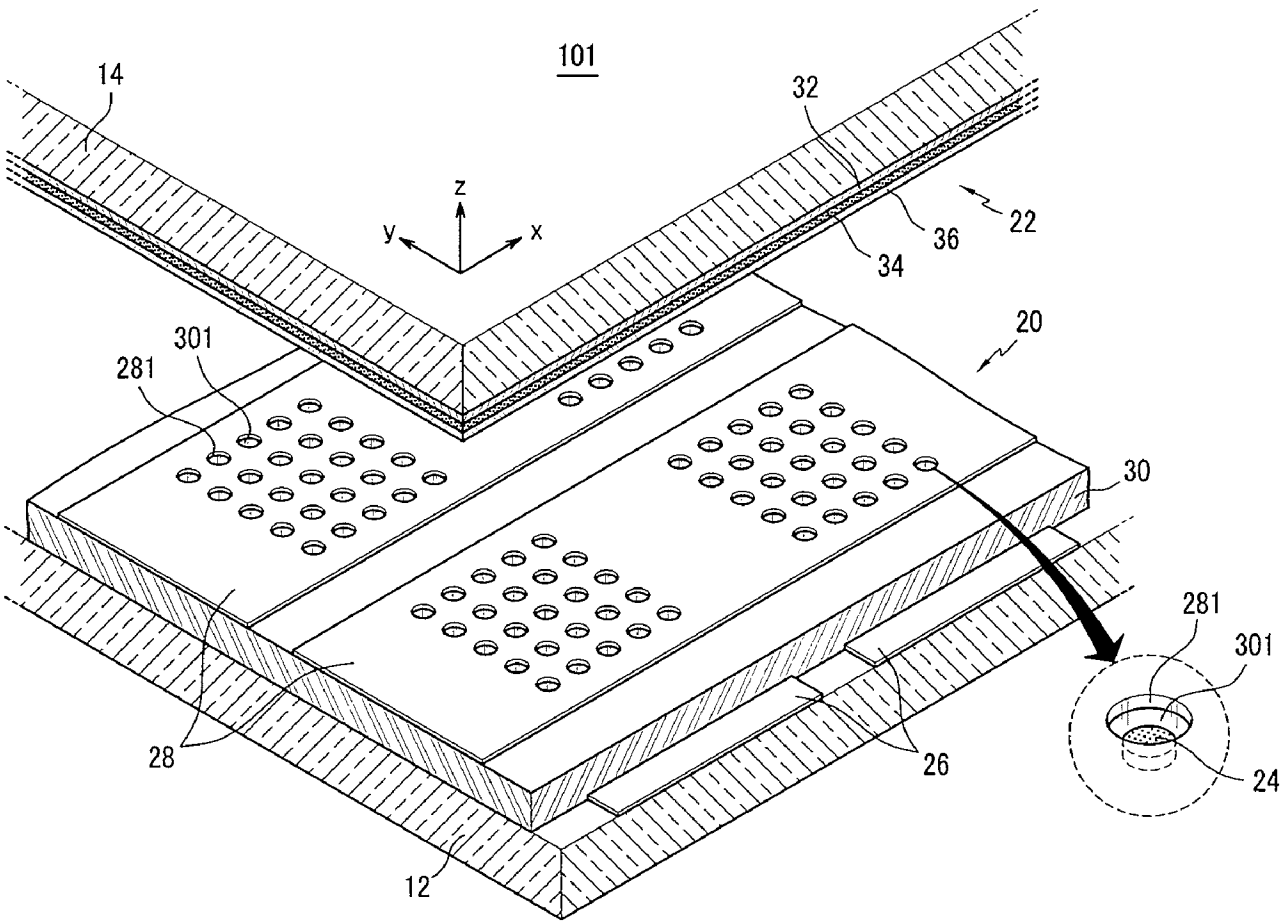
FIG. 2 is a partially cut-away perspective view illustrating an internal structure of an active area in the light emission device shown in FIG. 1.

Referring to FIGS. 1 and 2, a light emission device 101 of a first exemplary embodiment includes first and second substrates 12 and 14 facing each other in a parallel manner and with a gap (that may be predetermined) therebetween. A sealing member 16 is provided between peripheries of the first and second substrates 12 and 14 to seal the first and second substrates 12 and 14 together to thus form a vacuum vessel (or a vacuum chamber) 18. The inner space of the vacuum vessel 18 is kept to a degree of vacuum of about $10^{-6}$ Torr.

Inside vacuum vessel 18 sealed by the sealing member 16, each of the first and second substrates 12 and 14 may be divided into an active area from which visible light is actually emitted and a non-active area surrounding the active area. An electron emission unit 20 for emitting electrons is provided on an inner surface of the first substrate 12 (or on a side of the first substrate 12 facing the second substrate 14) at the active area, and a light emission unit 22 for emitting the visible light is provided on an inner surface of the second substrate 14 (or on a side of the second substrate 14 facing the first substrate 12) at the active area.

The second substrate 14 on which the light emission unit 22 is located may be a front substrate of the light emission device 101, and the first substrate 12 on which the electron emission unit 20 is located may be a rear substrate of the light emission device 101.

The electron emission unit 20 includes electron emission regions 24 and driving electrodes 26 and 28 for controlling an electron emission amount of the electron emission regions 24. The driving electrodes 26 and 28 include cathode electrodes 26 that are arranged in a stripe pattern extending in a first direction (y-axis direction of FIG. 2) of the first substrate 12 and gate electrodes 28 that are arranged in a stripe pattern extending in a second direction (x-axis direction of FIG. 2) crossing (e.g., perpendicular to) the first direction. An insulation layer 30 is interposed between the cathode electrodes 26 and the gate electrodes 28.

Openings 281 and openings 301 are respectively formed in the gate electrodes 28 and the insulation layer 30 at each region where the cathode and gate electrodes 26 and 28 cross each other. The electron emission regions 24 are located on the cathode electrodes 26 in the openings 301 of the insulation layer 30.

The electron emission regions 24 are formed of a material that emits electrons when an electric field is formed therearound under a vacuum atmosphere, such as a carbon-based material and/or a nanometer-sized material. For example, the electron emission regions 24 may include a material selected from the group consisting of carbon nanotubes, graphite, graphite nanofibers, diamonds, diamond-like carbon, fullerene ($C_{60}$), silicon nanowires, and combinations thereof.

Alternatively, the electron emission regions may be formed with a sharp tip structure made of a molybdenum-based material and/or a silicon-based material.

In one embodiment of the above-described structure, each of regions where the cathode electrodes 26 cross the gate electrodes 28 corresponds to a single pixel region of the light emission device 101. Alternatively, in another embodiment, two or more of the crossing regions may correspond to the single pixel region of the light emission device 101.

The light emission unit 22 includes an anode electrode 32, a phosphor layer 34 located on a surface of the anode electrode 32, and a reflection layer 36 covering the phosphor layer 34. The anode electrode 32 is an acceleration electrode that receives a high voltage (i.e., anode voltage) to maintain (or place) the phosphor layer 34 at a high potential state. In one embodiment, the anode electrode 32 is formed by a transparent conductive material, such as indium tin oxide (ITO) so that visible light emitted from the phosphor layer 34 can transmit through the anode electrode 32.

The phosphor layer 34 may be formed of a mixture of red, green, and blue phosphors, which can emit white light. In this case, the phosphor layer 34 may be formed on an entire active area of the second substrate 14 or may be divided into a plurality of sections corresponding to the pixel regions.

The reflection layer 36 may be an aluminum layer having a thickness of about several thousands of angstroms (Å) and including a plurality of tiny holes for passing the electrons. The reflection layer 36 functions to enhance the luminance of the light emission device 101 by reflecting the visible light, which is emitted from the phosphor layer 34 to the first substrate 12, toward the second substrate 14. The anode electrode 32 formed by the transparent conductive material can be eliminated, and the reflection layer 36 can function as the anode electrode by receiving the anode voltage.

Disposed between the first and second substrates 12 and 14 at the active area are spacers that are utilized (or able) to withstand a compression force applied to the vacuum vessel 18 and to uniformly maintain a gap between the first and second substrates 12 and 14.

The light emission device 101 is driven when a scan driving voltage (or signal) is applied to either the cathode electrodes 26 or the gate electrodes 28 (e.g., applied to the gate electrodes 28), a data driving voltage (or signal) is applied to the other electrodes 26 or 28 (e.g., the cathode electrodes 26), and a positive direct current (DC) anode voltage of thousands of volts or more is applied to the anode electrode 32.

Electric fields are formed around the electron emission regions 24 at the pixels where the voltage difference between the cathode and gate electrodes 26 and 28 is equal to or greater than the threshold value, and thus electrons are emitted from the electron emission regions 24. The emitted electrons, attracted by the anode voltage applied to the anode electrode 32, collide with a corresponding portion of the phosphor layer 34, thereby exciting the phosphor layer 34. A luminance of the phosphor layer 34 for each pixel corresponds to an electron emission amount of the corresponding pixel.

In the light emission device 101, the structure provided inside the vacuum vessel 18 slowly outgases such that a vacuum degree of the vacuum vessel 18 may be gradually decreased. Therefore, in one embodiment, an initial vacuum degree during a manufacturing process of the vacuum vessel 18 is provided at a degree higher than the later maintained vacuum degree. When the initial vacuum degree is set with a sufficiently high value, electron emission efficiency and lifetime of the electron emission regions 24 can be improved.

The light emission device 101 further includes a getter unit 38 and a barrier 40 provided between the first and second substrates 12 and 14 at the non-active area. The getter unit 38 is of an evaporating type having an adsorbing efficiency greater than that of a non-evaporating getter unit. The barrier 40 is located between the getter unit 38 and the active area, thereby preventing (or blocking) a diffusion of a conductive getter material toward the active area during a getter activating process.

Figure 3:
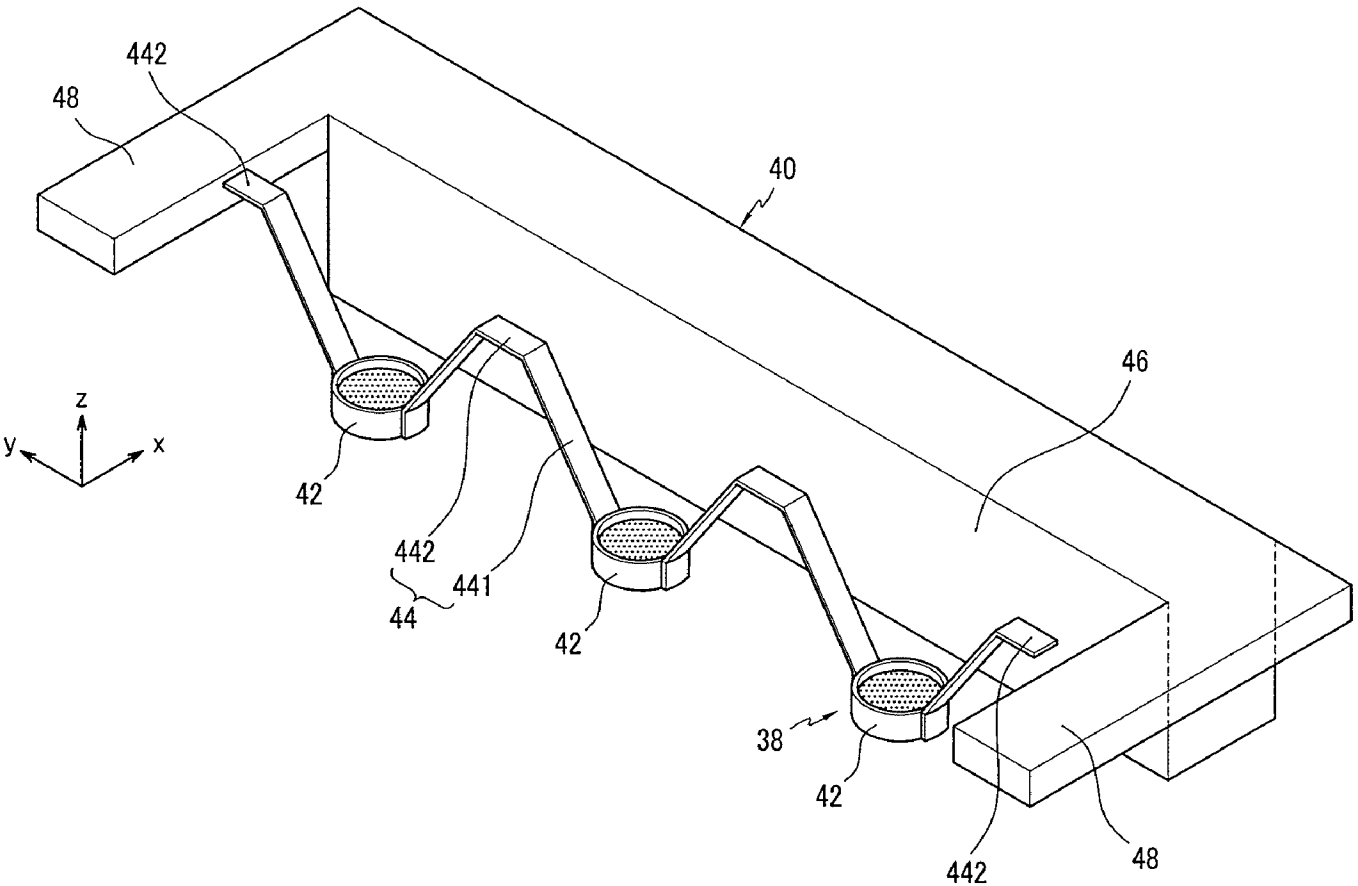
FIG. 3 is a perspective view illustrating a getter unit and a barrier of the light emission device shown in FIG. 1.

Referring to FIGS. 1 and 3, the getter unit 38 includes a getter receptacle 42 containing a getter material and that is mounted on one of the first substrate 12 or the second substrate 14, and a pair of supports 44 extended from the getter receptacle 42 along a thickness direction (z-axis direction of FIGS. 1 and 3) of the light emission device 101. A part of each support 44 contacts the other one of the first substrate 12 or the second substrate 14. FIG. 1 shows a case where the getter receptacle 42 is mounted on the first substrate 12, and a part of each support 44 contacts the second substrate 14.

Each support 44 includes a pair of inclined portions 441 having an interval (or a gap) therebetween that is gradually increasing in accordance with increasing distance from the getter receptacle 42, and a pair of fixed portions 442 each extended from each of the inclined portions 441 so as to be parallel with the inner surface of the first and second substrates 12 and 14. When the getter receptacle 42 is mounted on the first substrate 12, the fixed portions 442 contact the inner surface of the second substrate 14. The getter receptacle 42 and the supports 44 may be formed of a metal material.

The supports 44 are modified by an outer force applied thereto. That is, when the outer force is applied to the supports 44 along the thickness direction (z-axis direction of FIGS. 1 and 3) of the light emission device 101, an angle between the pair of inclined portions 441 becomes greater and a height of the supports 44 becomes smaller. In a case where the supports 44 have an elasticity (that may be predetermined), the supports 44 may be restored to the initial height and the inclined portions 441 are restored to the initial angle when the outer force is eliminated.

The getter unit 38 may be provided with a plurality of getter receptacles 42 that are connected with each other by the supports 44. In this case, one fixed portion 442 is disposed between the adjacent getter receptacles 42. FIG. 3 shows a case where the getter unit 38 includes three getter receptacles 42 connected to each other by the supports 44.

The getter material may include a material selected from the group consisting of barium (Ba), titanium (Ti), vanadium (V), zirconium (Zr), niobium (Nb), molybdenum (Mo), tantalum (Ta), barium-aluminum (Ba—Al), zirconium-aluminum (Zr—Al), silver-titanium (Ag—Ti), zirconium-nickel (Zr—Ni), and combinations thereof.

The barrier 40 includes a first barrier 46 disposed between the getter unit 38 and the active area while being parallel with the sealing member 16, and a pair of second barriers 48 extended from both-ends (or both-end portions) of the first barrier 46 toward the sealing member 16. The first barrier 46 has a height that is substantially identical with a gap between the first and second substrates 12 and 14. The second barriers 48 have a height that is smaller than that of the first barrier 46. The barrier 40 may be formed of glass, ceramic, and/or tempered glass.

During the getter activating process, the conductive getter material is diffused in all directions from the getter receptacles 42. The first barrier 46 blocks the diffusion of the getter material toward the active area, thereby preventing (or substantially preventing) a short circuit between the adjacent gate electrodes 28 and damage to the phosphor layer 34. The first barrier 46 also functions as an auxiliary spacer for withstanding compression force applied to the vacuum vessel 18 at the non-active area.

The second barriers 48 are provided to contact the one substrate that is in contact with the fixed portions 442 of the getter unit 38. That is, when the fixed portions 442 contact the second substrate 14, the second barriers 48 are also provided to contact the second substrate 14, as shown in FIG. 1. The second barrier 48 functions as a guide for setting a position of the getter unit 38 when the getter unit 38 is installed inside the vacuum vessel 18.

In addition, since the second barriers 48 have a height that is smaller than that of the first barrier 46, the getter material is diffused through a space under the second barriers 48 during the getter activating process. Thus, a diffusion area of the getter material is enlarged such that adsorbing efficiency of the gaseous molecules remaining within the vacuum vessel 18 may be improved. Since the space under the second barriers 48 is the non-active area, the getter material diffused through the space does not intrude into the active area.

An assembly process of the vacuum vessel 18 will be described in more detail with reference to FIGS. 4 and 5.

Figure 4:
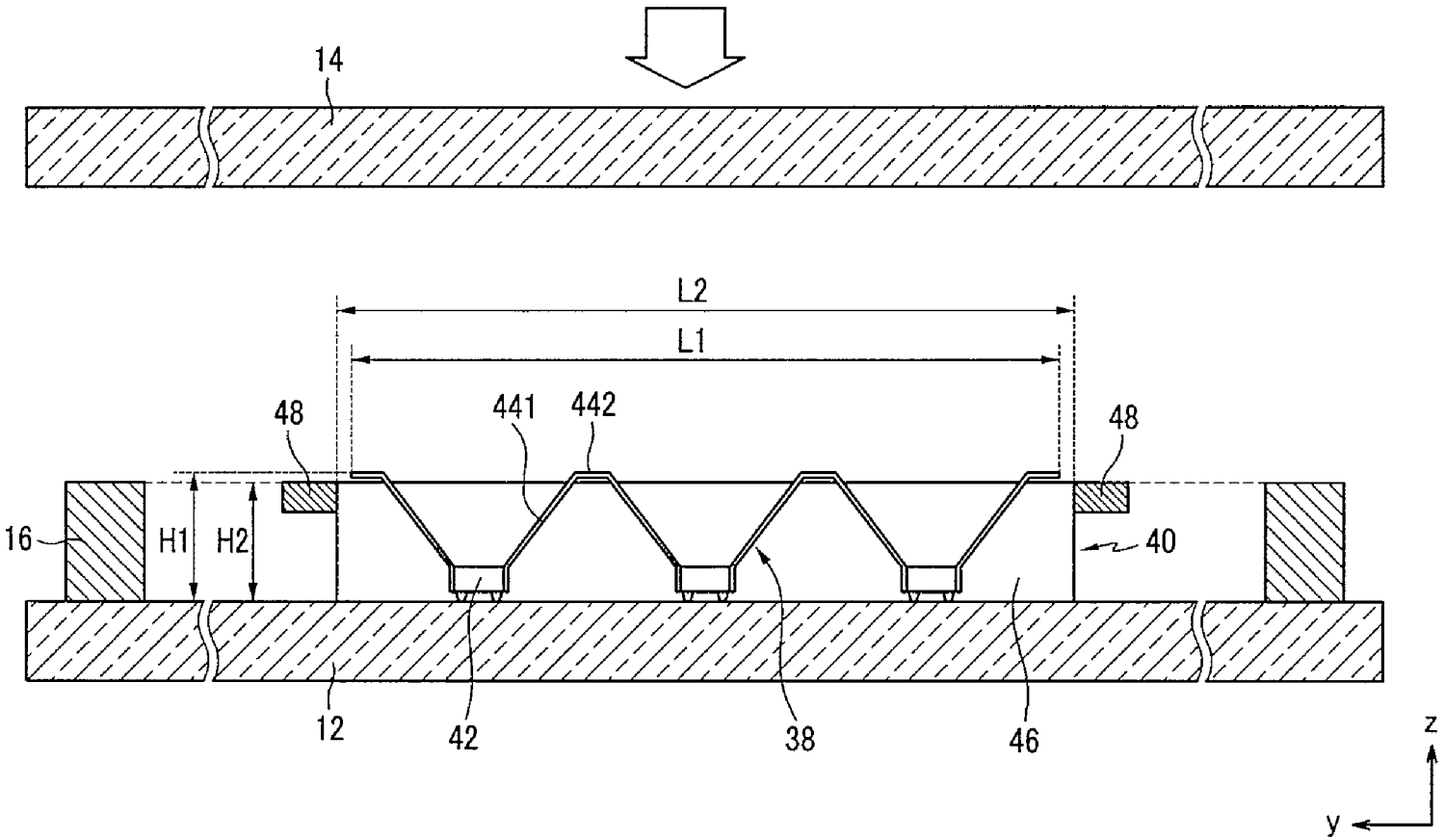
FIG. 4 is a sectional view illustrating a vacuum vessel of the light emission device shown in FIG. 1 before being assembled.
Figure 5:
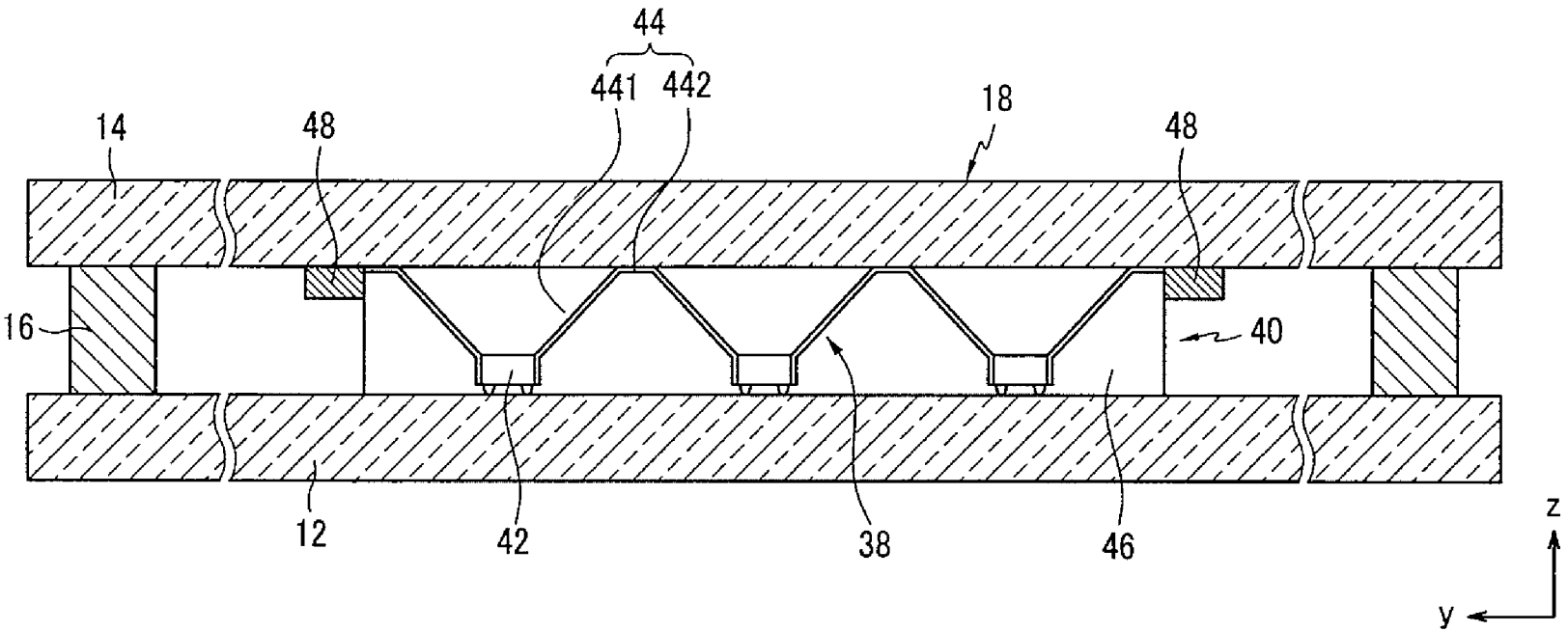
FIG. 5 is a sectional view illustrating the vacuum vessel of the light emission device shown in FIG. 1 after being assembled.

Referring to FIGS. 4 and 5, the sealing member 16, the barrier 40, and the getter unit 38 are aligned on one substrate (e.g., the first substrate 12) among the first and second substrates 12 and 14. A frit bar may be used as the sealing member 16. The frit bar is prepared by press-forming a mixture of a glass frit and an organic compound. Alternatively, a glass bar and frit layers formed on upper and lower surfaces of the glass bar may be used as the sealing member 16. Adhesive layers may be provided between the first substrate 12 and the barrier 40.

Before the first and second substrates 12 and 14 are sealed to each other, a height (H1 of FIG. 4) of the getter unit 38 is greater than a height (H2 of FIG. 4) of the barrier 40, and a length (L1 of FIG. 4) of the getter unit 38 is smaller than an interval (L2 of FIG. 4) between the pair of second barriers 48.

The second substrate 14 is aligned on the sealing member 16. Then, the resulting assembly is loaded in a firing furnace so that the first and second substrates 12 and 14 can be attached to each other by melting a surface of the frit bar or the frit layers. During the firing process, the second substrate 14 is pressed toward the first substrate 12.

Therefore, the fixed portions 442 are pressed by the outer force and the angle between the pair of the inclined portions 441 becomes greater. Also, the height of the getter unit 38 becomes smaller and the length of the getter unit 38 becomes greater. Due to the length expansion of the getter unit 38, the outermost fixed portions 442 contact the second barriers 48. Accordingly, modification of the getter unit 38 is stopped and a position of the getter unit 38 is fixed between the pair of second barriers 48.

Next, internal air is exhausted through an exhaust pipe provided on the first substrate. An end of the exhaust pipe is sealed, thereby completing the vacuum vessel. A high-frequency heating device is placed outside of the first substrate corresponding to a position where the getter receptacles 42 are located. The getter material is activated by heat induced from the high-frequency heating device.

The activated getter material is diffused in all directions from the getter receptacles 42 to form a getter layer. The getter layer adsorbs the remaining gaseous molecules within the vacuum vessel 18, thereby improving the vacuum degree of the vacuum vessel 18. At this time, the first barrier 46 blocks the diffusion of the getter material toward the active area. The getter layer is formed on an inner surface of the first barrier 46 (or on a side of the first barrier 46 facing away from the active area) and the inner surface of the second substrate 14.

The light emission device 101 according to the above-described exemplary embodiment may be used as a light source for emitting white light for a display panel that is of a non-emissive type. In the light emission device 101, the first and second substrates 12 and 14 may be spaced apart from each other by a relatively large distance ranging from about 5 to about 20 mm. By this relatively large distance between the first and second substrates 12 and 14, arcing in the vacuum vessel 18 can be reduced and thus it becomes possible to apply a high voltage of above 10 kV, and, in one embodiment, ranging from 10 to 15 kV, to the anode electrode 32.

A display device using the above-described light emission device as a light source will be described in more detail with reference to FIG. 6.

Figure 6:
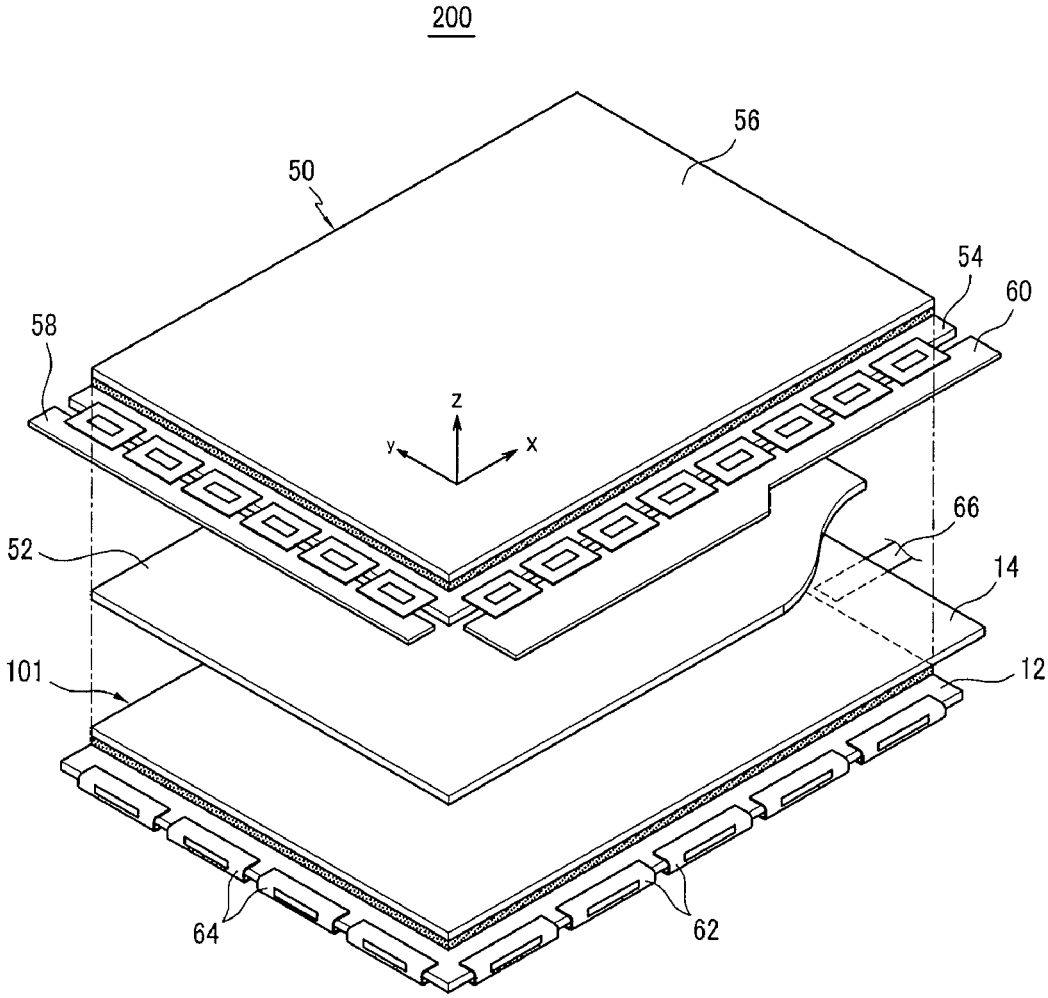
FIG. 6 is an exploded perspective view illustrating a display device using the light emission device shown in FIG. 1 as a light source according to an exemplary embodiment of the present invention.

Referring to FIG. 6, a display device 200 of this exemplary embodiment includes a light emission device 101 and a display panel 50 located in front of the light emission device 101. A diffuser 52 for uniformly diffusing light emitted from the light emission device 101 to the display panel 50 may be located between the light emission device 101 and the display panel 50. The diffuser 52 is spaced apart from the light emission device 101 by a distance that may be predetermined.

A liquid crystal display panel or another non-emissive type display panel may be used as the display panel 50. In the following description, a case where the display panel 50 is a liquid crystal display panel will be explained in more detailed as an example.

The display panel 50 includes a lower substrate 54 on which a plurality of thin film transistors (TFTs) and a plurality of pixel electrodes are formed, an upper substrate 56 on which a color filter layer and a common electrode are formed, and a liquid crystal layer provided between the lower and upper substrates 54 and 56. Polarizing plates are attached on a top surface of the upper substrate 56 and a bottom surface of the lower substrate 54 to polarize the light passing through the display panel 50.

The pixel electrode is arranged (or formed) for each sub-pixel, and the driving of each pixel electrode is controlled by a corresponding TFT (or driving TFT or TFTs). The pixel electrodes and the common electrode are formed of a transparent conductive material. The color filter layer includes red, green, and blue layers arranged to correspond to respective sub-pixels. Three sub-pixels, i.e., the red, green, and blue layers that are located side by side, define a single pixel.

When the TFT of a corresponding sub-pixel is turned on, an electric field is formed between the pixel electrode and the common electrode. As such, the light transmittance of the corresponding sub-pixel is varied in accordance with the variance of the twisting angle of liquid crystal molecules of the liquid crystal layer that is varied by the electric field. Here, the display panel 50 realizes a luminance and color (that may be predetermined) for each pixel by controlling the light transmittance of the sub-pixels.

In FIG. 6, a gate circuit board assembly 58 is for transmitting gate driving signals to each of gate electrodes of the TFTs, and a data circuit board assembly 60 is for transmitting data driving signals to each of source electrodes of the TFTs.

The light emission device 101 includes a plurality of pixels, the number of which is less than the number of pixels of the display panel 50 so that one pixel of the light emission device 101 corresponds to two or more pixels of the display panel 50. Each pixel of the light emission device 101 emits light in response to a highest gray level among gray levels of the corresponding pixels of the display panel 50. The light emission device 101 can represent gray levels of a gray scale ranging from 2 to 8 bits at each pixel.

For convenience, the pixels of the display panel 50 are referred to as first pixels and the pixels of the light emission device 101 are referred to as second pixels. The first pixels corresponding to one second pixel are referred to as a first pixel group.

In a driving process of the light emission device 101, a signal control unit (not shown) that controls the display panel 50 (i) detects the highest gray level of the first pixel group, (ii) operates a gray level required for emitting light from the second pixel in response to the detected high gray level and converts the operated gray level into digital data, (iii) generates a driving signal of the light emission device 101 using the digital data, and (iv) applies the driving signal to the light emission device 101.

The driving signal of the light emission device 101 includes a scan driving signal and a data driving signal. The cathode electrodes or the gate electrodes (e.g., the gate electrodes) are applied with the scan driving signal and the other electrodes (e.g., the cathode electrodes) are applied with a data driving signal.

Scan and data circuit board assemblies of the light emission device 101 may be located on a rear surface of the light emission device 101. In FIG. 6, first connectors 62 are for electrically connecting the cathode electrodes and the data circuit board assembly, and second connectors 64 are for electrically connecting the gate electrodes and the scan circuit board assembly. A third connector 66 is for applying anode voltage to the anode electrode.

When an image is displayed on the first pixel group, the corresponding second pixel of the light emission device 101 emits light with a gray level (that may be predetermined) by synchronizing with the first pixel group. That is, the light emission device 101 independently controls the luminance of each pixel and thus provides a proper intensity of light to the corresponding pixels of the display panel 50 in proportion to the luminance of the first pixel group. As a result, the display device 200 of the present exemplary embodiment can enhance the contrast ratio of the screen, thereby improving the display quality.

A light emission device according to a second exemplary embodiment of the present invention will be described with reference to FIG. 7. Like elements as of the first exemplary embodiment are denoted by like reference numerals.

Figure 7:
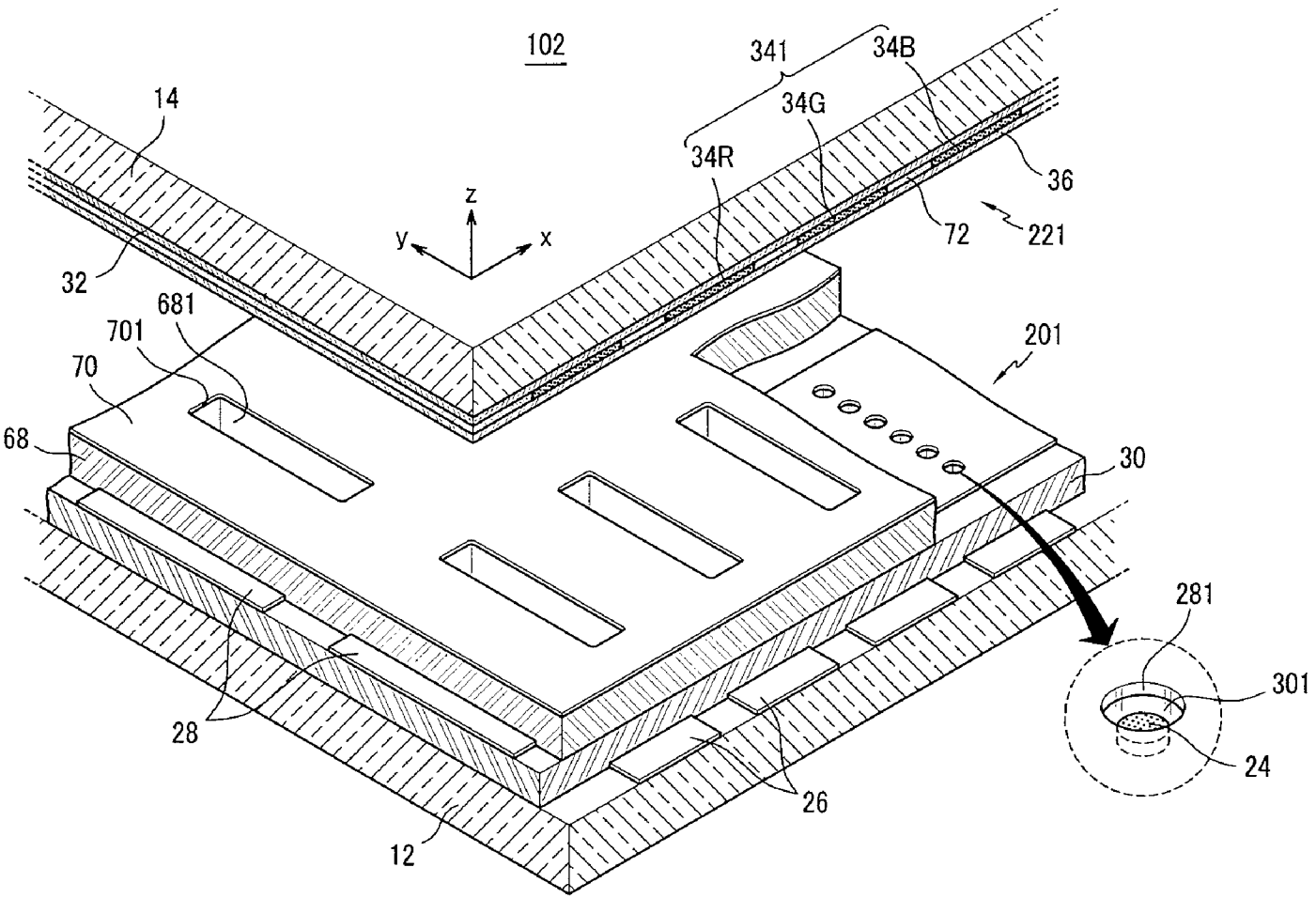
FIG. 7 is a partially cut-away perspective view illustrating an internal structure of an active area in a light emission device according to a second exemplary embodiment of the present invention.

Referring to FIG. 7, a light emission device 102 of this exemplary embodiment further includes a focusing electrode 70 disposed above the gate electrodes 28. If the insulation layer 30 located between the cathode electrodes 26 and the gate electrodes 28 is referred to as a first insulation layer, a second insulation layer 68 is provided between the gate electrodes 28 and the focusing electrode 70.

Openings 701 and openings 681 for passing electrons are respectively formed in the focusing electrode 70 and the second insulation layer 68. The focusing electrode 70 is applied with 0V or a negative direct current (DC) voltage ranging from several to tens of volts to converge (or focus) electrons on a central portion of a bundle of electron beams passing through the openings 701 of the focusing electrode 70.

Each of regions where the cathode electrodes 26 intersect the gate electrodes 28 may be formed to have a size that is smaller than that of the first exemplary embodiment. A number of the electron emission regions 24 provided in each of regions where the cathode electrodes 26 cross the gate electrodes 28 may be less than that of the first exemplary embodiment.

A light emission unit 221 includes phosphor layers 341 such as red, green, and blue phosphor layers 34R, 34G, and 34B that are spaced apart from each other, and a black layer 72 that is located between the phosphor layers 341.

In the above-described structure, each of regions where the cathode electrodes 26 cross the gate electrodes 28 corresponds to a singe sub-pixel region of the light emission device 102. The red, green, and blue phosphor layers 34R, 34G, and 34B are arranged to correspond to respective sub-pixel regions. Three sub-pixels, i.e., the red, green, and blue phosphor layers 34R, 34G, and 34B that are located side by side, define a single pixel.

An electron emission amount at each sub-pixel is controlled by driving voltages applied to the cathode electrodes 26 and the gate electrodes 28. The electrons emitted from the electron emission regions 24 collide with the phosphor layers 34R, 34G, and 34B of corresponding sub-pixels, thereby exciting the phosphor layers 34R, 34G, and 34B. The light emission device 102 realizes a luminance (that may be predetermined) and color for each pixel by controlling the electron emission amount of the sub-pixels, thereby displaying a color image.

While it has been described in the first and second exemplary embodiments that the electron emission units 20 and 201 are of a field emission array (FEA) type, the electron emission unit may be formed of a surface-conduction emission (SCE) type.

A light emission device according to a third exemplary embodiment of the present invention will be described with reference to FIG. 8 and FIG. 9.

Figure 8:
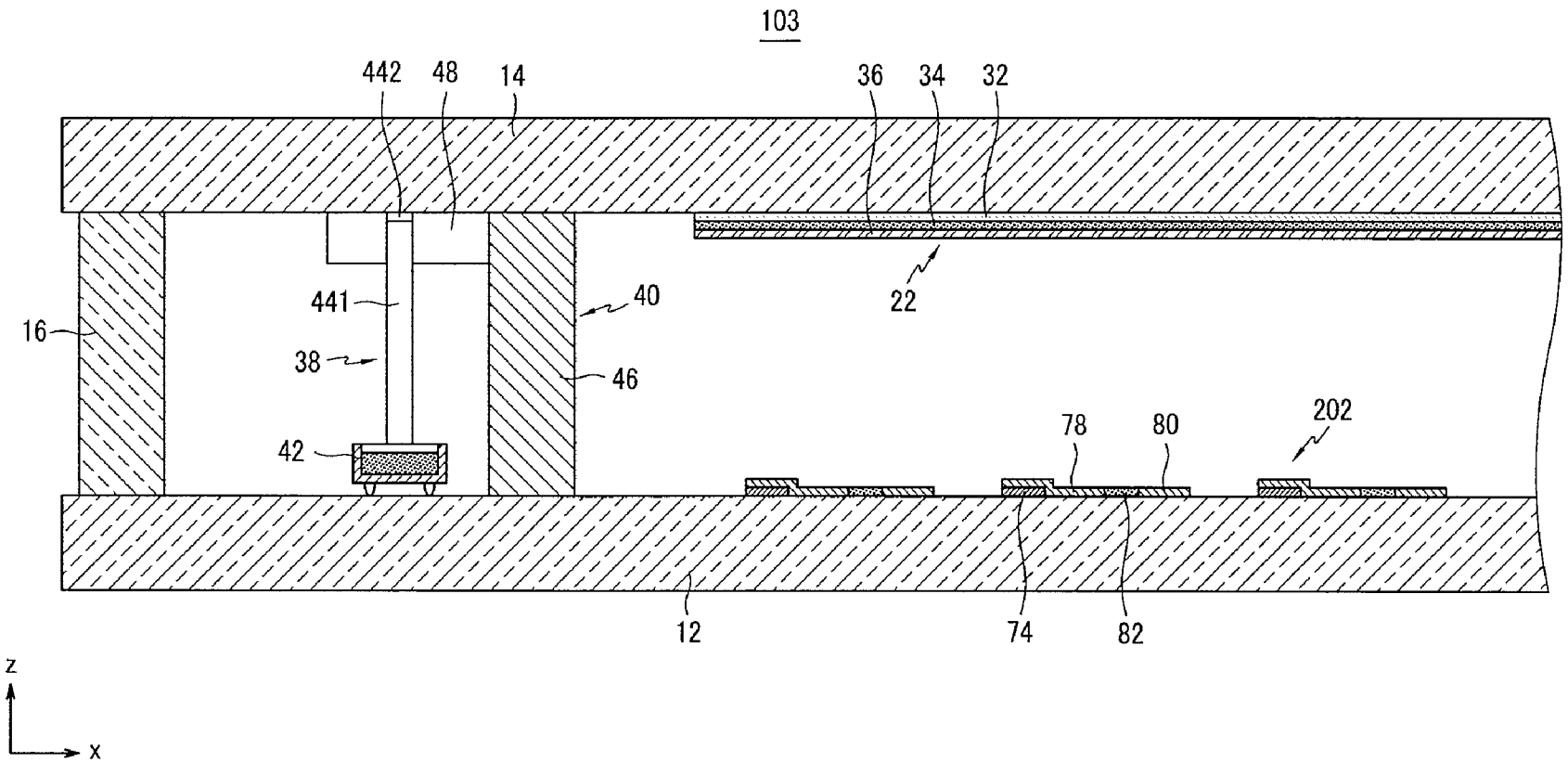
FIG. 8 is a partial sectional view illustrating a light emission device according to a third exemplary embodiment of the present invention.
Figure 9:
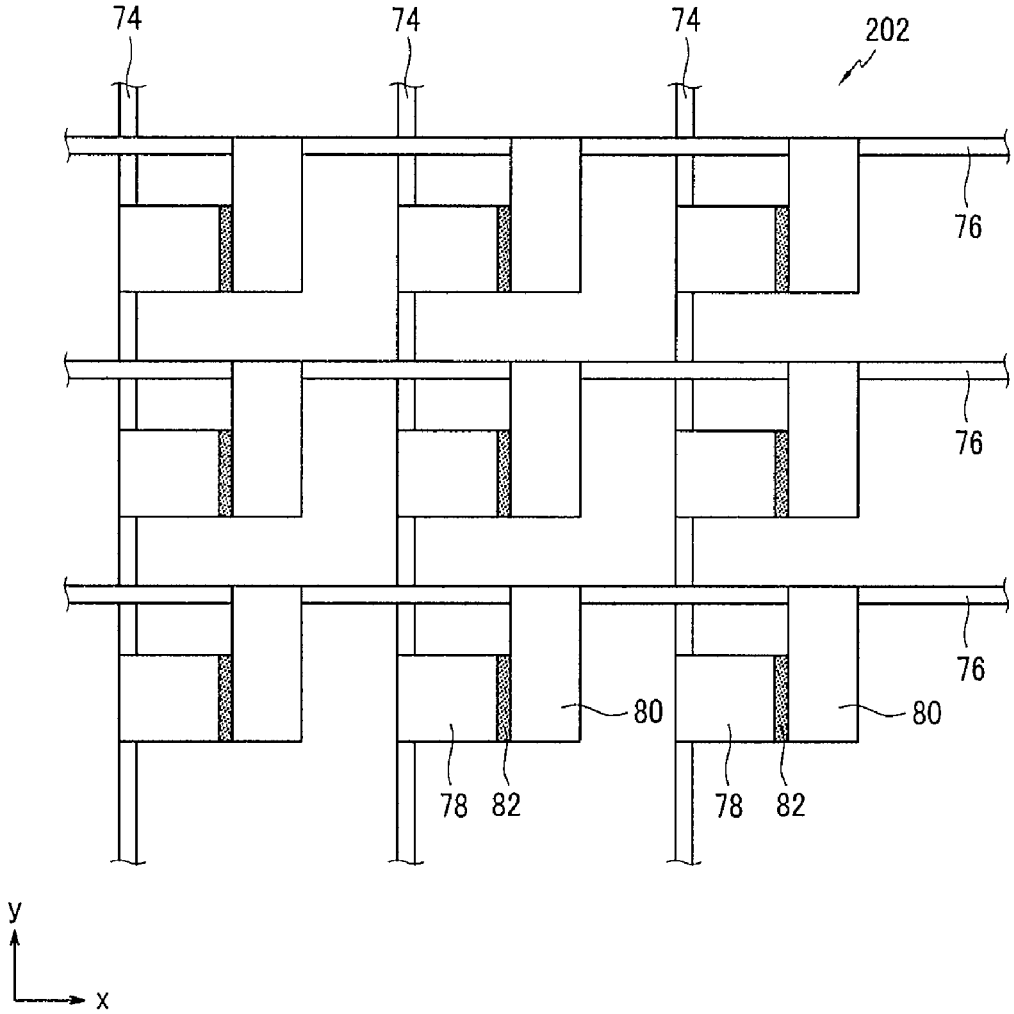
FIG. 9 is a partial top view illustrating an electron emission unit of the light emission device shown in FIG. 8.

Referring to FIGS. 8 and 9, a light emission device 103 according to this exemplary embodiment has the same construction (or substantially the same construction) as that of the light emission device according to the first exemplary embodiment except that an electron emission unit is formed of the SCE type. Like elements as of the first exemplary embodiment are denoted by like reference numerals.

The electron emission unit 202 includes first electrodes 74 extended in a first direction (y-axis direction of FIG. 9) of the first substrate 12, second electrodes 76 extended in a second direction (x-axis direction of FIG. 9) crossing (e.g., perpendicular to) the first direction and insulated from the first electrodes 74, first conductive layers 78 connected to the first electrodes 74, second conductive layers 80 connected to the second electrodes 76 and spaced apart from the first conductive layers 78, and electron emission regions 82 disposed between the first and second conductive layers 78 and 80.

The electron emission region may be formed by fine cracks provided between the first and second conductive layers 78 and 80. Alternatively, the electron emission region 82 may be formed of a carbon-based material. In the latter case, the electron emission region 82 may include a material selected from the group consisting of carbon nanotubes, graphite, graphite nanofibers, diamond-like carbon, fullerene ($C_{60}$), and combinations thereof.

In operation, when voltages are applied to the respective first and second electrodes 74 and 76, a current flows in a direction in parallel with the surface of the electron emission region 82 through the first and second conductive layers 78 and 80, thereby realizing the surface-conduction emission from the electron emission region 82.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A light emission device comprising:

a vacuum vessel comprising:

a first substrate, a second substrate facing the first substrate with a gap therebetween, the first and second substrates comprising an active area and a non-active area surrounding the active area, and a sealing member disposed between the first and second substrates and surrounding the non-active area;

an electron emission unit on the first substrate at the active area;

a light emission unit on the second substrate at the active area;

a getter unit between the first and second substrates at the non-active area; and a barrier disposed between the getter unit and the active area, wherein the barrier comprises:

a first barrier having a length and a height, the height being substantially identical with that of the gap between the first and second substrates; and a pair of second barriers extended from opposite terminal ends of the first barrier toward the sealing member and having a height that is smaller than the height of the first barrier, the opposite terminal ends defining the length of the first barrier.

2. The light emission device of claim 1, wherein the getter unit comprises:

a getter receptacle for containing an evaporating getter material; and a pair of supports for supporting the getter receptacle in the vacuum vessel, wherein the supports are adapted to be modifiable in a first direction parallel to a direction extending from the electron emission unit to the light emission unit of the light emission device and a second direction perpendicular to the first direction by an external force applied to the light emission device, and a position of the supports is adapted to be fixed in place by the second barriers.

3. The light emission device of claim 2, wherein the getter receptacle is mounted on one of the first substrate or the second substrate, wherein the supports comprise:

a pair of inclined portions extended from the getter receptacle toward the other one of the first substrate or the second substrate and having an interval therebetween that gradually increases as a distance away from the getter receptacle increases; and a pair of fixed portions extended from the inclined portions so as to be parallel with a side of the first substrate facing the second substrate and with a side of the second substrate facing the first substrate.

4. The light emission device of claim 3, wherein the second barriers are provided to contact the other one of the first substrate or the second substrate, and the fixed portions are located between the pair of second barriers while contacting the second barriers.

5. The light emission device of claim 4, wherein the getter receptacle comprises a plurality of getter receptacles each being supported by a corresponding pair of the supports, wherein one of the fixed portions is disposed between two adjacent getter receptacles of the plurality of getter receptacles, and wherein the outermost portions of the fixed portions contact the second barriers.

6. The light emission device of claim 1, wherein the electron emission unit comprises:

a plurality of cathode electrodes;

a plurality of gate electrodes crossing the cathode electrodes and insulated from the cathode electrodes; and a plurality of electron emission regions electrically connected to the cathode electrodes.

7. The light emission device of claim 6, wherein the electron emission unit further comprises a focusing electrode disposed between the light emission unit and the cathode and gate electrodes.

8. The light emission device of claim 1, wherein the electron emission unit comprises:

a plurality of first electrodes;

a plurality of second electrodes crossing the first electrodes and insulated from the first electrodes;

a plurality of first conductive layers electrically connected to the first electrodes;

a plurality of second conductive layers electrically connected to the second electrodes and spaced apart from the first conductive layers; and a plurality of electron emission regions between the first and second conductive layers.

9. The light emission device of claim 1, wherein the light emission unit comprises:

an anode electrode; and a phosphor layer on a side of the anode electrode, the phosphor layer being for emitting white visible light.

10. The light emission device of claim 1, wherein the light emission unit comprises:

an anode electrode;

red, green, and blue phosphor layers on a side of the anode electrode and spaced apart from each other; and a black layer between the phosphor layers.

11. A display device comprising:

a display panel for displaying an image; and a light emission device for emitting light toward the display panel, wherein the light emission device comprises:

a vacuum vessel comprising:

a first substrate, a second substrate facing the first substrate with a gap therebetween, the first and second substrates comprising an active area and a non-active area surrounding the active area, and a sealing member disposed between the first and second substrates and surrounding the non-active area;

an electron emission unit on the first substrate at the active area;

a light emission unit on the second substrate at the active area;

a getter unit between the first and second substrates at the non-active area; and a barrier disposed between the getter unit and the active area, wherein the barrier comprises:

a first barrier having a length and a height, the height being substantially identical with that of the gap between the first and second substrates; and a pair of second barriers extended from opposite terminal ends of the first barrier toward the sealing member and having a height that is smaller than the height of the first barrier, the opposite terminal ends defining the length of the first barrier.

12. The display device of claim 11, wherein the getter unit comprises:

a getter receptacle for containing an evaporating getter material; and a pair of supports for supporting the getter receptacle in the vacuum vessel, wherein the supports are adapted to be modifiable in a first direction parallel to a direction extending from the electron emission unit to the light emission unit of the light emission device and a second direction perpendicular to the first direction by an external force applied to the light emission device, and a position of the supports is adapted to be fixed in place by the second barriers.

13. The display device of claim 12, wherein the getter receptacle is mounted on one of the first substrate or the second substrate, wherein the supports comprise:

a pair of inclined portions extended from the getter receptacle toward the other one of the first substrate or the second substrate and having an interval therebetween that gradually increases as a distance away from the getter receptacle increases; and a pair of fixed portions extended from the inclined portions so as to be parallel with a side of the first substrate facing the second substrate and with a side of the second substrate facing the first substrate.

14. The display device of claim 13, wherein the second barriers are provided to contact the other one of the first substrate or the second substrate, and the fixed portions are located between the pair of second barriers while contacting the second barriers.

15. The display device of claim 14, wherein the getter receptacle comprises a plurality of getter receptacles each being supported by a corresponding pair of the supports, wherein one of the fixed portions is disposed between two adjacent getter receptacles of the plurality of getter receptacles, and wherein the outermost fixed portions of the fixed portions contact the second barriers.

16. The display device of claim 11, wherein the display panel comprises a plurality of first pixels, and the light emission device comprises a plurality of second pixels, the second pixels being less in number than the first pixels and a luminance of each of the second pixels being independently controlled.

17. The display device of claim 16, wherein the display panel is a liquid crystal display panel.

* * * * *